US006293761B1

(12) United States Patent
Ganster et al.

(10) Patent No.: US 6,293,761 B1
(45) Date of Patent: Sep. 25, 2001

(54) VARIABLE DISPLACEMENT SWASH PLATE TYPE COMPRESSOR HAVING PIVOT PIN

(75) Inventors: Peter Edward Ganster, Plymouth; Thomas Edward Bazinet, Walled Lake; David Henry Herder, Plymouth, all of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/471,648

(22) Filed: Dec. 23, 1999

(51) Int. Cl.[7] ..... F04B 1/26
(52) U.S. Cl. ..... 417/222.1; 92/71; 91/505
(58) Field of Search ..... 417/222.1; 92/71; 74/839; 91/505

(56) References Cited

U.S. PATENT DOCUMENTS 4,145,163 * 3/1979 Fogelberg et al. ..... 417/222.1
4,869,154 * 9/1989 Takahashi et al. ..... 92/71
5,056,416 * 10/1991 Ota et al. ..... 92/71
5,112,197 * 5/1992 Swain et al. ..... 417/222.1
5,165,321 * 11/1992 Arimoto et al. ..... 91/499
5,882,179 * 3/1999 Ota et al. ..... 417/222.1
6,044,751 * 4/2000 Kimura et al. ..... 92/71

FOREIGN PATENT DOCUMENTS 994876 11/1951 (FR) .
58-162782 9/1983 (JP) .
9-175159 1/1999 (JP) .

* cited by examiner

*Primary Examiner*—Cheryl J. Tyler
(74) *Attorney, Agent, or Firm*—Larry I. Shelton

(57) ABSTRACT

A variable displacement swash plate type compressor (10) incorporates a swash plate (48) slidably mounted on a drive shaft (32), with at least one pin (70, 72) disposed between the swash plate (48) and drive shaft (32). The pin (70, 72) provides a bearing surface between the swash plate (48) and the drive shaft (32) during relative movement therebetween.

18 Claims, 5 Drawing Sheets

VARIABLE DISPLACEMENT SWASH PLATE TYPE COMPRESSOR HAVING PIVOT PIN

BACKGROUND OF THE INVENTION

This invention relates to a variable displacement swash plate type compressor, particularly adapted for use in a vehicular air conditioning system. The compressor includes a pin disposed between a swash plate and a drive shaft that provides a pivot surface during operation of the compressor.

A typical variable displacement swash plate type compressor includes a cylinder block provided with a number of cylinders, a piston disposed in each of the cylinders of the cylinder block, a rotatably supported drive shaft, and a swash plate. The swash plate is rotated by the drive shaft through a hinge mechanism. Rotation of the swash plate reciprocatively drives the pistons. The length of the stroke of the piston is varied by an inclination angle of the swash plate. As the inclination angle of the swash plate changes, the swash plate is caused to slide adjacent the drive shaft, with contact occurring continuously between the swash plate and the drive shaft. The change of the angle of the swash plate should occur as smoothly as possible to assure smooth changes in compressor displacement. The amount and type of contact between the swash plate and the drive shaft must be controlled to minimize wear between the swash plate and drive shaft.

A variety of prior art structures have been disclosed for providing an interface between the swash plate and the drive shaft. One such Structure uses a swash plate wherein its interior surface has been machined. The drive shaft is typically inserted through a hole defined by the interior surface of the swash plate. The interior surface of the swash plate is machined to create two conical surfaces that meet to form an apex near the central portion of the interior surface. The apex contacts the outer surface of the drive shaft. A disadvantage of the structure described is that the machining required creates added expense. In addition, the machined surfaces of the swash plate often require surface hardening creating even more added expense.

Another structure for providing an interface between the swash plate and the drive shaft uses a sleeve slidably mounted on the outer surface of the drive shaft. The outer surface of the sleeve is shaped to conform to an inner bearing surface of the swash plate that defines a hole. The swash plate remains in constant contact with the spherical sleeve. Constant contact increases wear due to the frictional forces acting on the large contact surface. Creating the curved surface on the swash plate to mate with the spherical sleeve requires additional machining, thus adding expense.

SUMMARY OF THE INVENTION

This invention includes a variable displacement swash plate type compressor. The compressor includes a relatively simple structure that provides an interface between a swash plate and a drive shaft. Friction and wear between the swash plate and drive shaft is minimized. The compressor provides smooth operation and increased durability. Since machining of the swash plate is minimized, the compressor has relatively low manufacturing costs.

In a preferred embodiment, a variable displacement compressor includes a rotatably supported drive shaft having an outer surface and a longitudinal axis. A swash plate includes a plate and a hub mounted to the plate. The hub includes an opening receiving the drive shaft. A pin is disposed between the hub and the drive shaft to provide a bearing surface between the hub and the drive shaft.

Various objects and advantages of this invention will become apparent to those skilled in the art from the following detailed description of the preferred embodiments, when read in light of the accompanying drawings.

DETAILED DESCRIPTION

Figure 1:
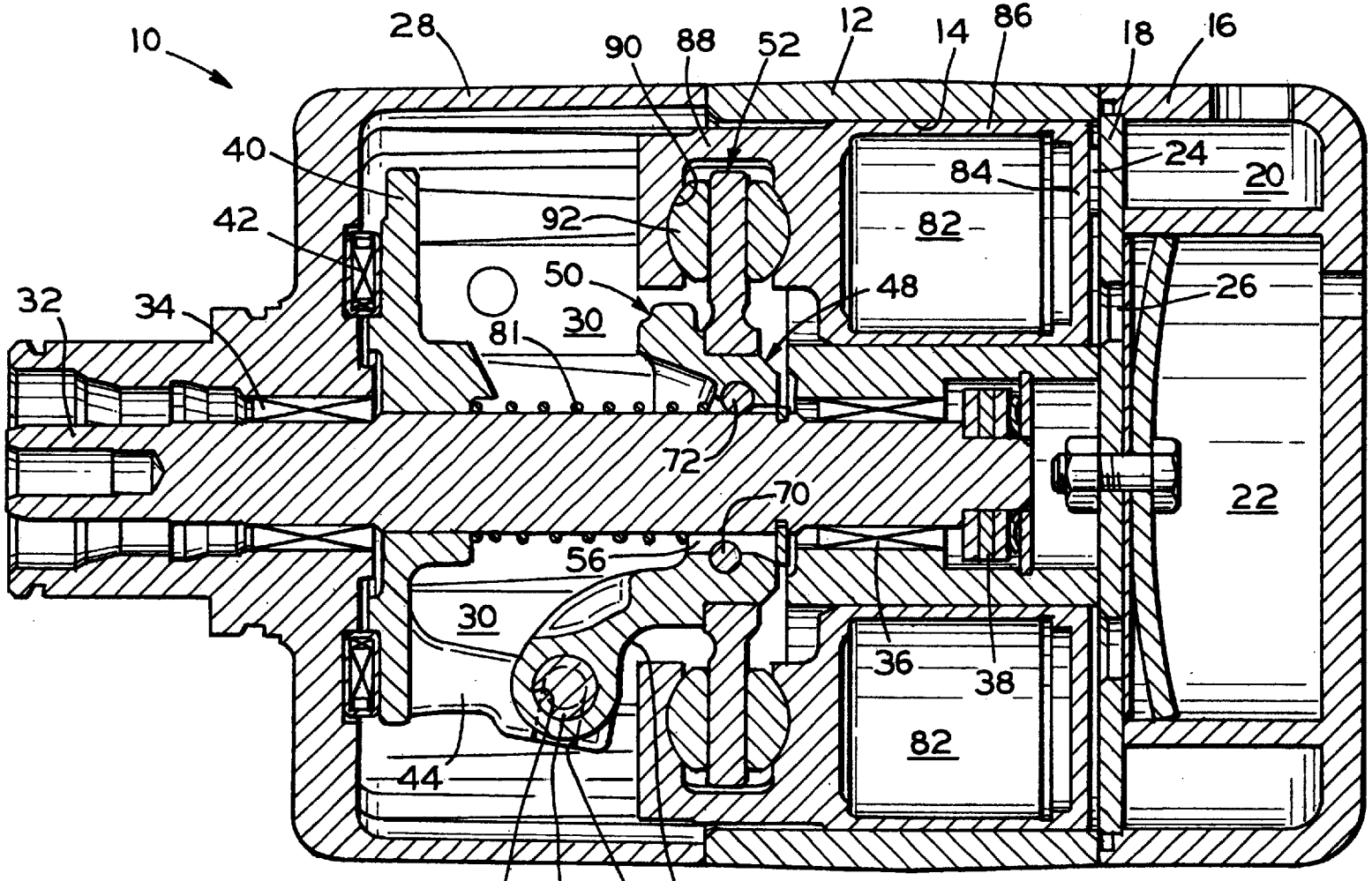
FIG. 1 is a sectional view of a swash plate type compressor incorporating the features of the invention wherein a bearing surface between the swash plate and the associated drive shaft is established by pins, and the swash plate is shown at a minimum inclination angle.
Figure 2:
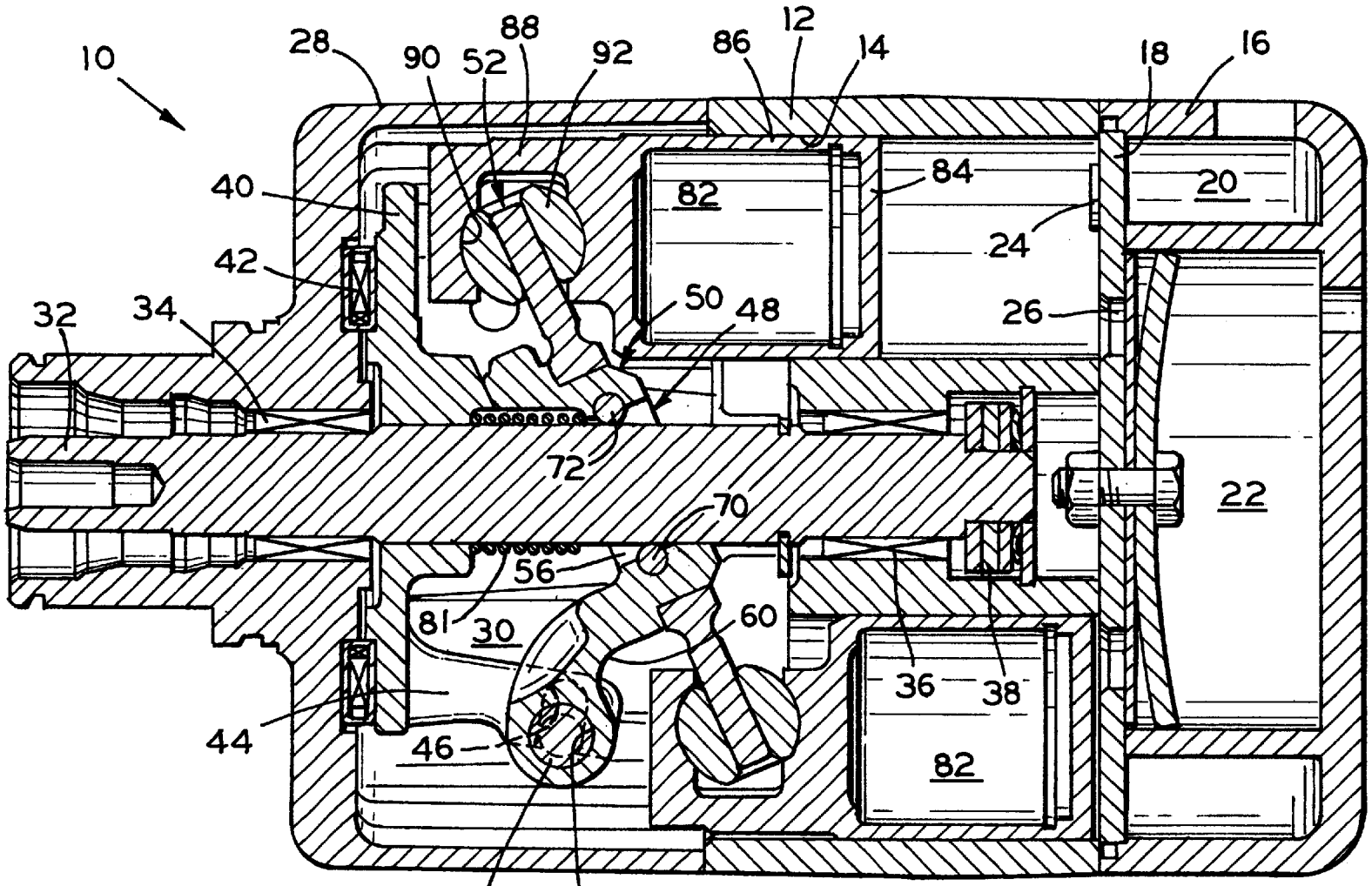
FIG. 2 is a sectional view of the swash plate type compressor illustrated in FIG. 1 showing the swash plate at a maximum inclination angle.
Figure 4:
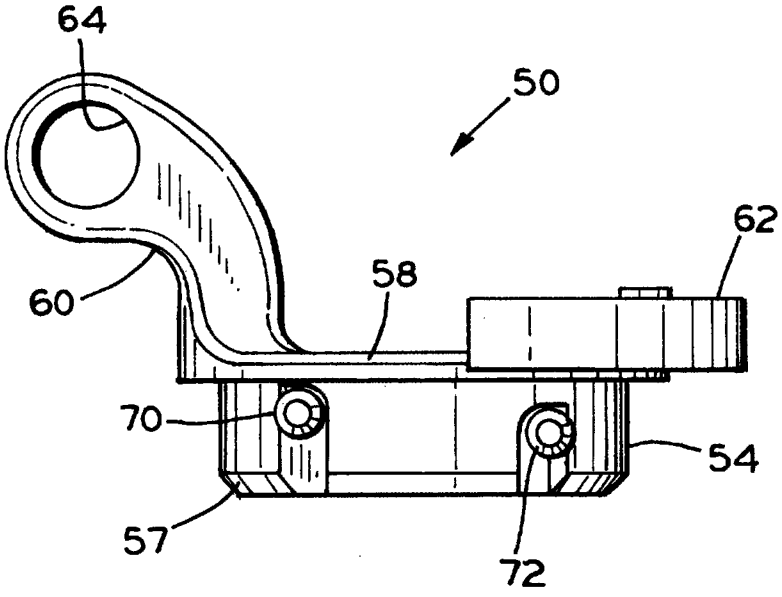
FIG. 4 is a side view of a hub of the swash plate assembly illustrated in FIG. 3 showing an offset relationship of pins.

A variable displacement swash plate type compressor according to this invention is indicated generally at 10 in FIGS. 1 and 2. The compressor 10 includes a cylinder block 12 having a plurality of cylinders 14 formed therein. A head 16 is disposed adjacent one end of the cylinder block 12 and sealingly closes the end of the cylinder block 12. A valve plate 18 is disposed between the cylinder block 12 and the head 16. The head 16 includes a suction chamber 20 and a discharge chamber 22. The suction chamber 20 communicates with the cylinders 14 through a suction port 24 disposed in the valve plate 18. The cylinders 14 communicate with the discharge chamber 22 through a discharge port 26 disposed in the valve plate 18. A crankcase 28 is sealingly disposed at the other end of the cylinder block 12. The crankcase 28 and cylinder block 12 cooperate to form an airtight crank chamber 30.

A drive shaft 32 is centrally disposed in and arranged to extend through the crankcase 28 to the cylinder block 12. The drive shaft 32 is rotatably supported by a bearing 34 mounted in the crankcase 28 and a bearing 36 mounted in the cylinder block 12. Longitudinal movement of the drive shaft 32 is restricted by a thrust bearing 38 mounted in the cylinder block 12.

A rotor 40 is fixedly mounted on an outer surface of the drive shaft 32 adjacent one end of the crankcase 28 within the crank chamber 30. A thrust bearing 42 is mounted on an inner wall of the crankcase 28 in the crank chamber 30 disposed between the crankcase 28 and the rotor 40 and provides a bearing surface for the rotor 40. An arm 44 extends laterally from a surface of the rotor 40 opposite the surface of the rotor 40 that contacts the thrust bearing 42. A rectangular slot 46 is formed in the distal end of the arm 44. A pin 47 has one end slidingly disposed in the slot 46 of the arm 44 of the rotor 40.

Figure 3:
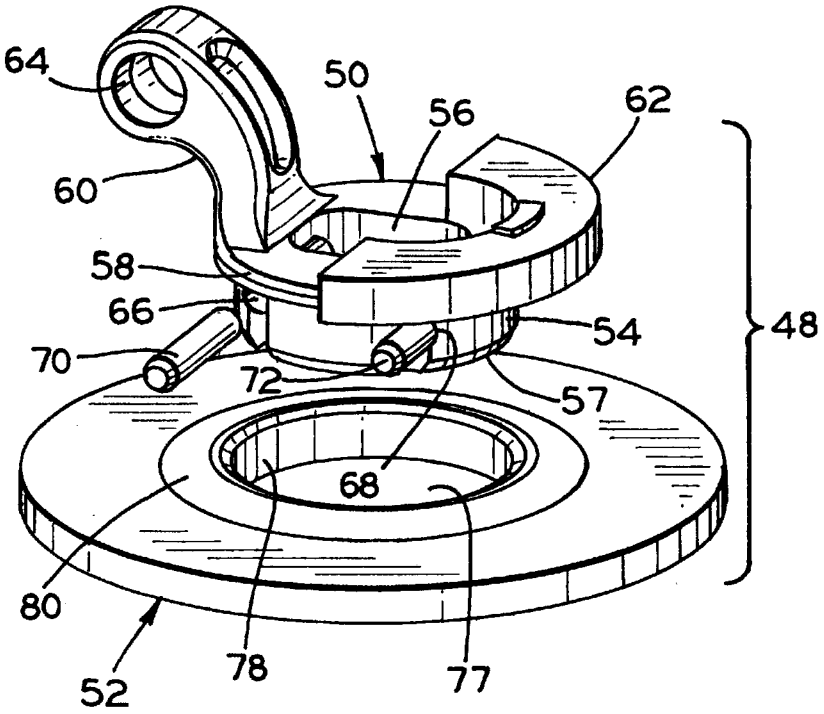
FIG. 3 is an exploded perspective view of a swash plate assembly removed from the compressor of FIGS. 1 and 2 for clarity of illustration.

In FIG. 3, a swash plate 48 is shown removed from the balance of the compressor 10. In the embodiment of FIGS.

1, 2 and 3, the swash plate 48 is formed as an assembly of a hub 50 and an annular plate 52. The hub 50 and the annular plate 52 are manufactured as separate parts and then fitted together. In other embodiments, the swash plate 48 may be formed as a single part.

The hub 50 includes a hollow, cylindrical main body 54 having a central opening 56. Preferably, the main body 54 terminates in a beveled end surface 57. An annular rim 58, having a diameter greater than the main body 54, is formed at an end of the main body 54 opposite end surface 57. An arm 60 extends upwardly and radially outwardly from an upper surface of the rim 58. A semi-circular counterweight 62 is provided on the upper surface of the rim 58 at a diametrically opposed position to the arm 60.

A distal end of the arm 60 includes a hole 64. The pin 47, with one end slidingly disposed in the slot 46 of the arm 44 of the rotor 40, has the other end fixedly disposed in the hole 64 of the arm 60.

Two holes 66, 68 are formed in the main body 54 of the hub 50. Each hole 66 and 68 is formed along an axis that passes through a first portion of the main body 54, through the central opening 56, and through a second portion of the main body 54.

Two pins 70, 72 are received in holes 66, 68, respectively. Each pin 70 and 72 is a cylindrical member having a longitudinal axis, wherein its length is greater than its diameter. Each pin 70 and 72 can be press fit into its receiving hole so that it does not rotate. Alternately, each receiving hole 66 and 68 can be formed with tolerances so that a pin may rotate within its respective hole. When the pins 70, 72 are inserted into their respective holes 66, 68, a portion of the outer surfaces of the pins 70, 72 is exposed in the central opening 56. Preferably, holes 66, 68 are offset axially from one another. In other words, an axis of pin 70 is laterally spaced from an axis of pin 72. In a most preferred embodiment, the axis of each pin 70 and 72 is offset from a centerline of the annular plate 52. For example, the axis of pin 70 is offset from the centerline of annular plate 52 toward the rim 58 while the axis of pin 72 is offset from the centerline of the annular plate 52 toward the beveled end surface 53.

The annular plate 52 has central opening 77 bounded by an annular surface 78. A raised lip 80 is formed about the aperture 77 on opposing sides of the annular plate 52. The main body 54 of the hub 50 is inserted into the opening 77 of the annular plate 52 to form the swash plate 48. The inner surface 78 of the annular plate 52 and an outer surface of the main body 54 of the hub 50 are manufactured to facilitate a press fit between the hub 50 and the annular plate 52.

When assembled, the swash plate 48 has a central opening 56 that receives the drive shaft 32. As shown in FIGS. 1 and 2, a longitudinal axis of the drive shaft 32 is substantially perpendicular to longitudinal axes of the pins 70, 72 mounted on the hub 50.

A coil spring 81 is placed around the outer surface of the drive shaft 32. One end of the spring 81 abuts the rotor 40. An opposite end of the spring 81 abuts the rim 58 of the hub 50.

A plurality of pistons 82 is slidably disposed in the cylinders 14 in the cylinder block 12. Each of the pistons 82 includes a head 84, a dependent skirt portion 96, and a bridge portion 88. The skirt portion 86 terminates in the bridge portion 88. A pair of concave shoe pockets 90 are formed in the bridge portion 88 of each piston 82 for rotatably supporting a pair of semi-spherical shoes 92. The spherical surfaces of the shoes 92 are disposed in the shoe pockets 90 with a flat bearing surface disposed opposite the spherical face for slidable engagement with opposite surfaces of the annular plate 52 of the swash plate 48.

The operation of the compressor 10 is accomplished by rotation of the drive shaft 32 by an auxiliary drive means (not shown), which may typically be the internal combustion engine of a vehicle. Rotation of the drive shaft 32 causes the rotor 40 to correspondingly rotate with the drive shaft 32. The swash plate 48 is connected to the rotor 40 by a hinge mechanism formed by the pin 47 slidingly disposed in the slot 46 of the arm 44 of the rotor 40 and fixedly disposed in the hole 64 of the arm 60 of the hub 50. As the rotor 40 rotates, the connection made by the pin 47 between the swash plate 48 and the rotor 40 causes the swash plate 48 to rotate. During rotation, the swash plate 48 is disposed at an inclination angle. The sliding engagement between the annular plate 52 and the shoes 92 causes a reciprocation of the pistons 82 due to the inclination angle of the swash plate assembly.

The capacity of the compressor 10 can be changed by changing the inclination angle of the swash plate 48 and thereby changing the length of the stroke for the pistons 82. The inclination angle of the swash plate 48 is changed by a control valve means (not shown) used to control the backpressure in the crank chamber 30. The control valve means is connected to the suction chamber 20, the discharge chamber 22, and the crank chamber 30 such that refrigerant gas under pressure can be controllably conveyed from one chamber to another to change the pressure in the crank chamber 30. The reciprocating action of the pistons 82 causes refrigerant gas to be introduced from the suction chamber 20 of the head 16 into the respective cylinders 14 through the suction port 24. The refrigerant gas is then compressed by the reciprocating motion of the pistons 82. The compressed refrigerant gas is then discharged from the respective cylinders 14 into the discharge chamber 22 of the head 16 through the discharge port 26.

When the pressure level in the suction chamber 20 is raised with an increase of the thermal load of an evaporator, the control valve means cuts off the refrigerant gas traveling from the discharge chamber 22 into the crank chamber 30. The refrigerant gas is cut off so that the pressure level in the crank chamber 30 is lowered. When the pressure level in the crank chamber 30 is lowered, a backpressure acting on the respective pistons 82 is decreased, and therefore, the angle of inclination of the swash plate 48 is increased. Namely, the pin 47 of the hinge mechanism connecting the rotor 40 and the swash plate 48 is moved slidably within the slot 46. The swash plate 48 is moved against the force of the spring 81. Therefore, the angle of inclination of the swash plate 48 is increased, and as a result, the length of the stroke of the respective pistons 82 is increased.

Conversely, when the pressure level in the suction chamber 20 is lowered with a decrease of the thermal load of the evaporator, the control valve means passes the compressed refrigerant gas at the pressure level of the discharge chamber 22 into the crank chamber 30. When the pressure level in the crank chamber 30 rises, a backpressure acting on the respective piston 82 is increased, and therefore, the angle of inclination of the swash plate 48 is decreased. More specifically, the pin 47 of the hinge mechanism connecting the rotor 40 and the swash plate 48 is moved slidably within the slot 46. As a result, the swash plate 48 yields to the force of the spring 81. Therefore, the inclination angle of the swash plate 48 is decreased, and as a result, the length of the stroke of the respective pistons 82 is reduced.

As the inclination angle of the swash plate 48 is changed, movement of the swash plate 48 occurs in a direction parallel to the longitudinal axis of the drive shaft 32. At least one pin 72 is disposed between the drive shaft 32 and the hub 50. In the illustrated embodiment, most clearly shown in FIGS. 1 and 2, two pins 70, 72 are disposed in the hub 50 on diametrically opposite sides of the drive shaft 32. The pins 70, 72 provide a pivot and bearing surface between the swash plate 48 and the drive shaft 32 to prevent direct contact between the hub 50 and the drive shaft 32. FIG. 1 shows the swash plate 48 at a minimum angle whereby only a single pin 72 is in contact with the drive shaft 32. FIG. 2 shows the swash plate 48 at a maximum angle whereby both pins 70, 72 are in contact with the drive shaft 32. The offset of the holes 66, 68 in which the pins 70, 72 are inserted, minimizes the clearance between the pins 70, 72 and the drive shaft 32 when the swash plate 48 is at the maximum angle. The offset relationship minimizes movement of the swash plate 48 relative to the drive shaft 32 in a direction perpendicular to the longitudinal axis of the drive shaft 32, thereby facilitating smoother operation of the compressor 10.

The use of the pins 70, 72 as discussed above eliminates the need for complex machining and surface hardening of the swash plate 48, thereby reducing manufacturing costs. Both the pins 70, 72 and the drive shaft 32 can easily and economically be surface hardened to provide cooperating hardened surfaces. The pins 70, 72 and the drive shaft 32 are typically manufactured with smooth outer surfaces to thereby facilitate smoother operation of the compressor 10.

Figure 5:
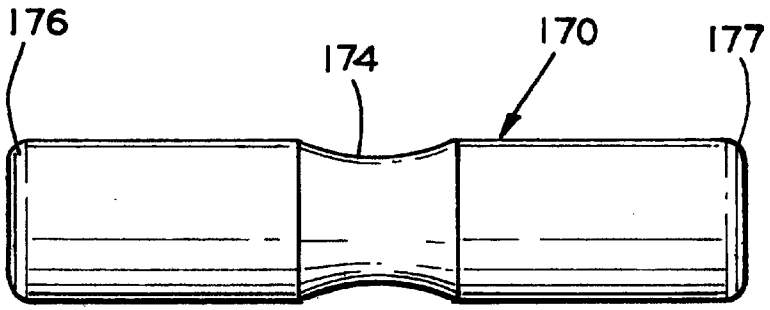
FIG. 5 is an enlarged side view of a second embodiment of a pin according to this invention that provides a bearing surface between a drive shaft and a swash plate in a compressor.

A second embodiment of a pin according to this invention is indicated at 170 in FIG. 5. The pin 170 is a generally cylindrical member and can be substituted for one or both of pins 70 and 72 in hub 50 described above. The pin 170 includes a contoured (concave) section or groove 174 formed in its outer surface between the ends. Preferably, the groove 174 has a radius (curvature) complementary to the outer circumference (curvature) of the drive shaft 32 to provide a maximized bearing surface. The groove 174 provides a bearing surface between the pin 170 and the drive shaft 32 when the pin 170 mounted in the hub 50 contacts the drive shaft 32. The bearing surface is arcuate and extends over a greater area than the relatively narrow contact area provided by pins 70 and 72 contacting the drive shaft 32. Preferably, the pin 170 includes chamfered or beveled ends 176 and 177.

Figure 6:
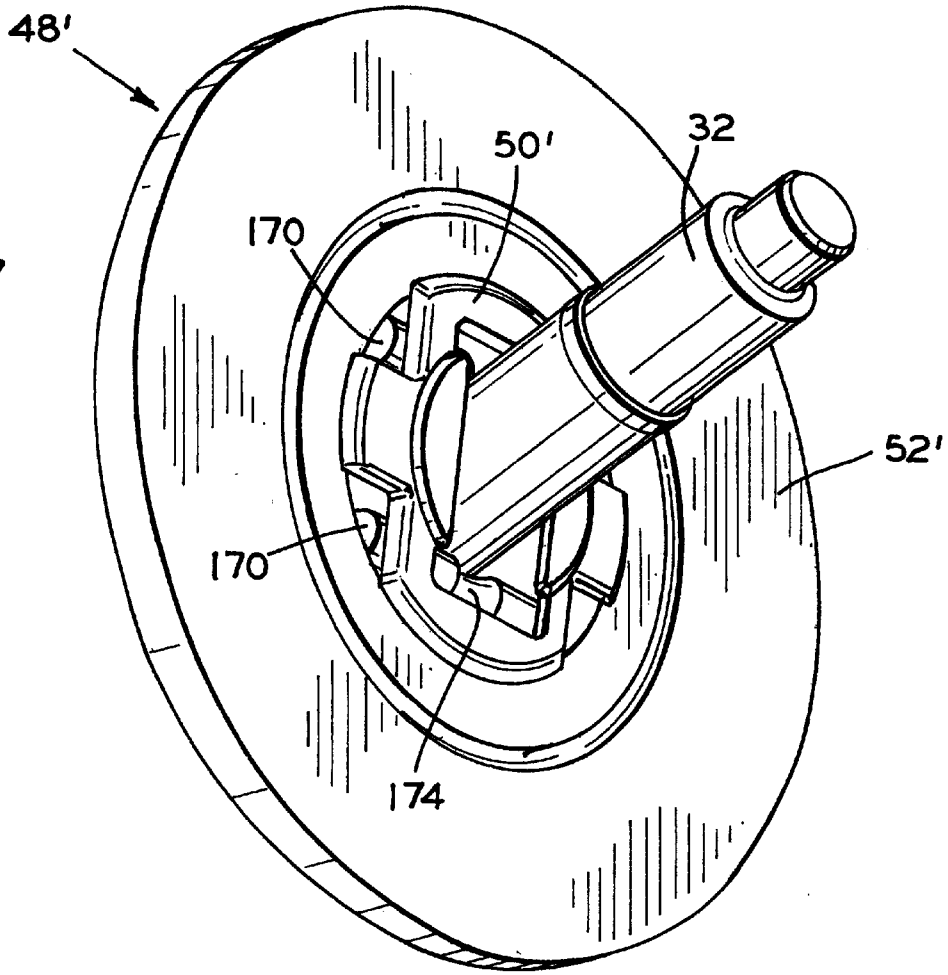
FIG. 6 is a perspective view of a second embodiment of swash plate according to this invention including pins as shown in FIG. 6.

FIG. 6 is an enlarged perspective view of a second swash plate 48' according to this invention. Two pins 170 are received in respective holes formed in a hub 50'. The hub 50' is fitted onto a plate 52'. In the illustrated position of the swash plate 48', the groove 174 engages the drive shaft 32, thereby providing a relatively large bearing area. The swash plate 48' can be substituted for swash plate 48 in compressor 10.

Figure 7:
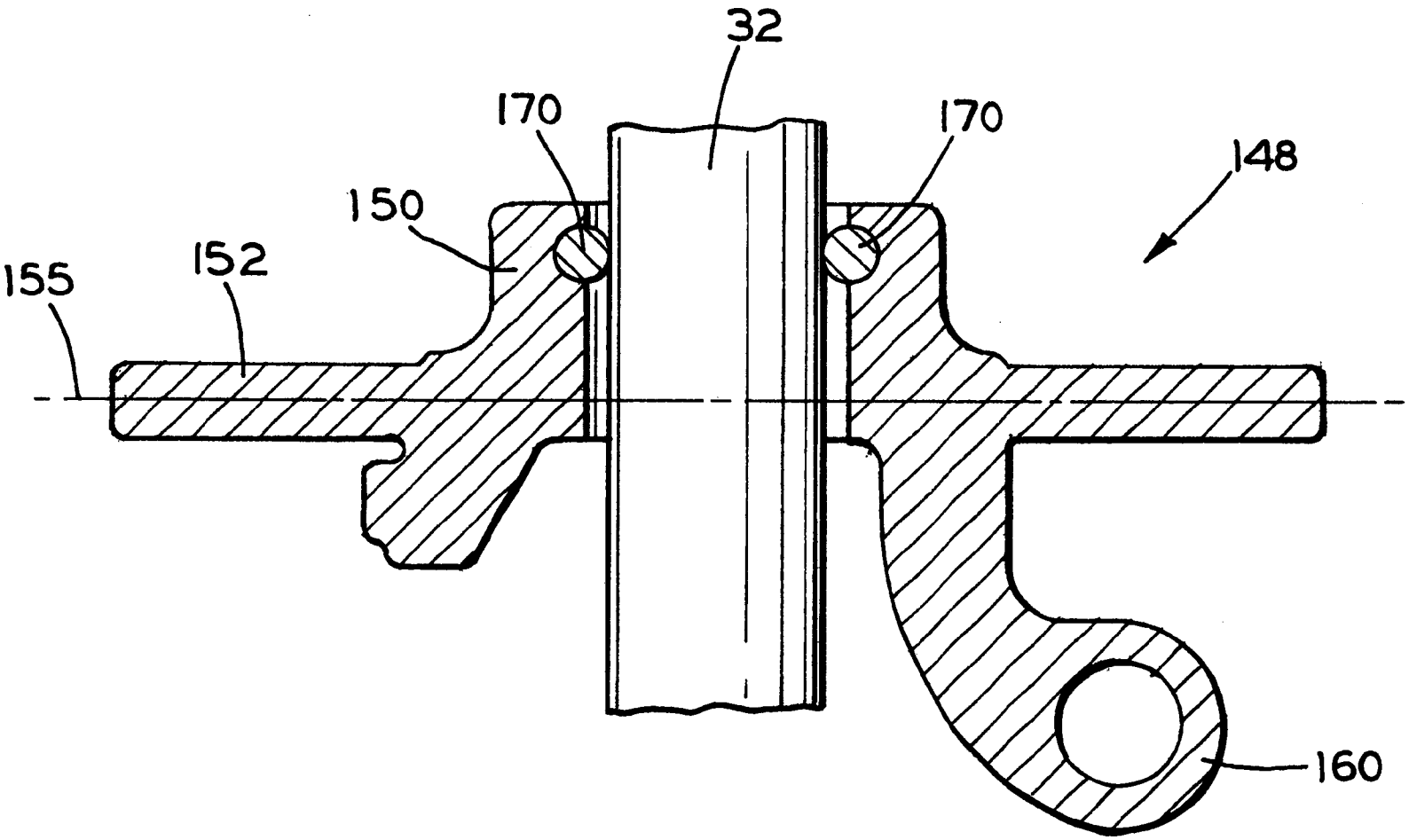
FIG. 7 is a sectional view of a portion of a third embodiment of a swash plate according to this invention.

FIG. 7 is a sectional view of a third swash plate 148 according to this invention. The swash plate 148 includes a hub portion 150, a plate portion 152, and an arm 160 formed as a single element. A pair of pins 170 are received in respective holes formed in the hub portion 150 on opposite sides of the drive shaft 32. In this embodiment, the axis for each pin 170 is laterally spaced from a centerline 155 of the plate portion 152 at approximately the same distance from and on the same side of the centerline 155 of the plate portion 152. Alternatively, pins 70 and 72 can be substituted for pins 170. The swash plate 148 can be substituted for swash plate 48 in compressor 10.

From the foregoing description, one ordinarily skilled in the art can easily ascertain the essential characteristics of this invention and, without departing from the spirit and scope thereof, can make various changes and modifications to the invention to adapt it to various usages and conditions. For example, although two pins 70, 72 are shown in the drawings, it will be readily apparent to those ordinarily skilled in the art that one pin or more than two pins could be used.

What is claimed is:

1. A variable displacement swash plate type compressor comprising:

a cylinder block having a plurality of cylinders arranged radially and circumferentially therein;

a crankcase attached to said cylinder block and cooperating with said cylinder block to define an airtight sealed crank chamber;

a drive shaft having an outer surface and a longitudinal axis, said drive shaft rotatably supported by bearing means in said crankcase and said cylinder block;

a rotor mounted on said drive shaft in said crank chamber;

a swash plate having a central opening and opposed surfaces, said drive shaft extending through the opening of said swash plate;

a hinge disposed between said rotor and said swash plate to permit said swash plate to be slidable along the outer surface of said drive shaft to thereby change an inclination angle of said swash plate relative to the longitudinal axis of the drive shaft;

at least one cylindrical pin disposed between said swash plate and said drive shaft to provide a bearing surface between said swash plate and said drive shaft, said pin having a longitudinal axis which is substantially perpendicular to the longitudinal axis of said drive shaft;

a piston reciprocatively disposed in each of the cylinders of said block, each said piston having a pair of shoe pockets;

a rotatable shoe disposed in each of the shoe pockets of each said piston, said shoes being operatively engaged with said opposed surfaces of said swash plate.

2. The compressor defined in claim 1 wherein said pin is received in a hole formed in said swash plate.

3. The compressor defined in claim 1 wherein said pin includes a groove in its outer surface to provide a bearing surface between said swash plate and said drive shaft.

4. The compressor defined in claim 1 wherein two pins are disposed between said swash plate and said drive shaft, wherein an axis of a first pin is spaced from an axis of a second pin.

5. The compressor defined in claim 4 wherein each of said pins is received in a respective hole formed in the swash plate.

6. The compressor defined in claim 1 wherein said swash plate includes a hub fitted to a plate.

7. The compressor defined in claim 6 wherein said pin is received in a hole formed in said hub.

8. The compressor defined in claim 7 wherein an outer surface of said pin is exposed in an opening formed in said hub.

9. A variable displacement compressor comprising:

a rotatably supported drive shaft having an outer surface and a longitudinal axis;

a swash plate having an opening through which the drive shaft passes; and a substantially cylindrical pin disposed between the swash plate and the drive shaft to provide a bearing surface between the swash plate and the drive shaft, the pin having a longitudinal axis which is substantially perpendicular to the longitudinal axis of the drive shaft.

10. The variable displacement compressor as defined in claim 9 wherein a second pin is also disposed between the swash plate and the drive shaft to provide a bearing surface between the swash plate and the drive shaft.

11. The variable displacement compressor as defined in claim 9 wherein the pin includes a contoured portion.

12. The variable displacement compressor as defined in claim 9 wherein the swash plate includes a hub and the pin is received in a hole formed in the hub.

13. A swash plate for a variable displacement compressor, the compressor including a rotatably supported drive shaft having an outer surface and a longitudinal axis, the swash plate comprising:

a plate;

a hub mounted to the plate, the hub including an opening for receiving the drive shaft; and at least one substantially cylindrical pin disposed between the hub and the drive shaft to provide a bearing surface between the hub and the drive shaft, the at least one pin having a longitudinal axis which is substantially perpendicular to the longitudinal axis of the drive shaft.

14. The swash plate defined in claim 13 wherein a hole is formed in the hub for receiving the at least one pin.

15. The swash plate defined in claim 14 wherein the at least one pin is exposed in the opening of the hub.

16. The swash plate defined in claim 13 wherein the at least one pin includes a groove to provide a bearing surface between the hub and the drive shaft.

17. The swash plate defined in claim 16 wherein the at least one pin is received in a hole formed in the hub.

18. The swash plate defined in claim 17 wherein the at least one pin is a first pin and including a second pin, wherein an axis of the first pin is laterally spaced from an axis of the second pin.

* * * * *